US005301739A

United States Patent [19]

Cook

[11] Patent Number: 5,301,739

[45] Date of Patent: Apr. 12, 1994

[54] METHOD FOR CASTING AND DENSIFICATION

[76] Inventor: Arnold J. Cook, 801 James Way, Mt. Pleasant, Pa. 15666

[21] Appl. No.: 906,373

[22] Filed: Jun. 30, 1992

[51] Int. Cl.[5] ..... B22D 27/13; B22D 19/14

[52] U.S. Cl. ..... 164/97; 164/120

[58] Field of Search ..... 164/120, 97

[56] References Cited

U.S. PATENT DOCUMENTS 3,547,180 12/1970 Cochran et al. ..... 164/97

FOREIGN PATENT DOCUMENTS 386384 10/1989 European Pat. Off. ..... 164/120
2504424 10/1982 France ..... 164/120
60-130461 7/1985 Japan ..... 164/120
559771 5/1977 U.S.S.R. ..... 164/120

*Primary Examiner*—Kuang Y. Lin

[57] ABSTRACT

The present invention is a method for casting and densification. The method is comprised of the steps of filling a mold in a pressure vessel to a predetermined level with molten metal and then increasing the pressure in the vessel such that voids formed within the metal are substantially closed without removing the mold with the metal from the pressure vessel. Preferably, after the increasing pressure step, there is the step of cooling the molten metal to ambient temperatures. In one embodiment, the increasing pressure step includes the step of increasing pressure in the vessel at a predetermined rate through the liquidus, liquidus/solidus and solidus phases of the metal. Alternatively, the increasing pressure step can include the step of increasing pressure at a predetermined rate through the liquidus/solidus and solidus phase of the metal. Alternatively, the increasing pressure step can include the step of increasing pressure at a predetermined rate through the solidus phase of the metal. The method is not limited to a type of mold or casting medium. For instance, investment or permanent molds could be used.

26 Claims, 3 Drawing Sheets

METHOD FOR CASTING AND DENSIFICATION

FIELD OF THE INVENTION

The present invention is related in general to casting. More specifically, the present invention is related to a method of casting and densification in one operation.

BACKGROUND OF THE INVENTION

Castings containing voids cannot be used in many applications. Besides having a weaker structure than comparative solid castings, castings having voids can become softer and yield from the pressure in the voids when their temperature is raised. Further, blisters can form and rupture, thereby causing problems to component performance.

Typically, there are three different types of voids or porosities that occur in metal castings; voids caused by the metal not reaching portions within the mold, voids formed by trapped gas or gas formation and voids caused by shrinkage of the metal when it solidifies. In order to remove the voids from a metal casting, it is known in the prior art to first cast a component in a casting apparatus. After solidification, the cast part is then removed from the casting apparatus and mold and placed in a hot isostatic press (HIP) apparatus. Essentially, the HIP apparatus reheats the casting to the working portion of its solid phase while increasing to very high pressures (30,000–60,000 psi), thus, densifying the casting by softening the metal and mechanically forcing the voids closed.

This two-stage process of formation and densification has many problems though. The secondary HIP process is very time consuming, expensive and not always successful. The HIP process normally takes from 4–48 hours and requires pressures of 30,000–60,000 psi. HIP equipment for aircraft size components cost millions of dollars and is expensive to set up and operate. Furthermore, in the HIP process, the component must be maintained below its melting temperature. If the temperature goes too high, the component will deform since it is no longer in contact with the mold that was used to establish its shape.

FIGS. 1*a*–1*e* show a casting process which is known in the prior art. Typically, as shown in FIG. 1*a*, molten metal is introduced into a mold. Trapped gases and unfilled voids often exist at this stage. As shown in FIG. 1*b*, the molten metal cools through its liquid phase. Many molten metals chemically react with the mold materials, which can cause additional gas formation in the molten metal. Reactions which cause gas can occur with both monolithic and composite systems at different phases during the casting. In monolithic casting reactions can occur at the different phases of the metal at different temperatures. Reactions often occur with the mold material, the casting atmosphere, and the dissolved gases as they come out of solution. Pressure can also affect the amount of reaction—more gas molecules normally cause greater reactions, as does higher levels of contact with the mold.

The same problems occur and are more complex in the formation of composites. When reinforcements are infiltrated, it is not uncommon for the metal to react with either oxides on the reinforcement or the reinforcement itself. Dissolved gases may also react with the reinforcement in solution or as they come out of solution. These reactions can be either small or violent and are normally exothermic and create gases which can end up in the casting in the form of porosity. Next, as shown in FIG. 1*c*, the metal cools through its liquid/solid phase were shrinkage voids start to form and dissolved gas can come out of solution.

In the liquid/solid phase of aluminum, shrinkage voids are normally around 4% of the casting volume. This depends on the nature of this phase and decreases with alloys that are closer to eutectic. To solve the problem of liquid/solid phase shrinkage, a number of steps are normally taken as standard casting practice: metal is introduced at a higher temperature than the mold itself, extra metal is added to a larger cross section then actually needed for the shape in the mold with additional sprues and risers, and the sprues and risers are made very large to provide the extra hot metal. The goal is to have the sprues and risers be the last areas to solidify. These methods act to reduce the amount of shrinkage inside the part. However, accomplishing these steps successfully often requires significant trial and error on the sprue design, mold and melt temperatures. It is often difficult or impossible to remove all of this shrinkage from castings with standard casting practices.

Next, as shown in FIG. 1*d*, the metal is essentially solidified and cools through its solid phase. Solid phase shrinkage, for 6061 aluminum for example, is 0.00023 inches of material for every fahrenheit degree drop.

Consequently, as shown in FIG. 1*e*, the solidified metal parts contains various forms of voids which were formed at various stages throughout its cool down. In order to diminish or eliminate this porosity, the parts are removed from the mold and then placed on holders in a hot isostatic press (HIP) to force the voids closed. This secondary process is very time consuming, expensive and not always successful. It involves the parts being reheated to a temperature below the liquid/solid phase while pressure is increased to very high pressure to mechanically work the metal into the voids. The process normally takes from 4 to 48 hours and requires pressures of 30,000 to 60,000 psi. The equipment for HIPing aircraft size components costs millions of dollars and is expensive to set up and operate.

In HIPing, the part is heated to the working portion of its solid phase so that the part does not change shape. If the temperature of the metal is too high the metal will reflow and no longer be the desired part shape. The metal must be taken high enough in temperature in a high pressure atmosphere so that it softens and the high pressure on the surface of the part transfers through the part and mechanically works to crush any voids inside. The voids are not completely removed, just greatly reduced in size. Because the metal is not liquid it does not flow easily. Very high pressures on the order of 30,000–60,000 PSI are required. The thicker the part, the higher the pressure and the longer the time required to close the voids and the greater the difficulty in closing all the voids.

The present invention facilitates casting and densification in one operation. The method is significantly faster than previous known casting/densification processes and requires less expensive equipment and lower pressures for equivalent degrees of densification.

SUMMARY OF THE INVENTION

The present invention is a method for casting and densification, preferably in one operation. The method is comprised of the steps of filling a mold in a pressure vessel to a predetermined level with molten metal and then the step of increasing the pressure in the vessel such that voids formed within the metal are substantially closed without removing the mold with the metal from the pressure vessel. Preferably, after the increasing pressure step, there is the step of cooling the molten metal to ambient temperatures.

In one embodiment, the increasing pressure step includes the step of increasing pressure in the vessel at a predetermined rate through the liquid, liquid/solid and solid phases of the metal. Alternatively, the increasing pressure step includes the step of increasing pressure at a predetermined rate through the liquid/solid and solid phase of the metal. Alternatively, the increasing pressure step includes the step of increasing pressure at a predetermined rate through the solid phase of the metal. The method is not limited to a type of mold. For instance, investment or permanent molds can be used.

In a preferred embodiment, the predetermined rate is defined as an increase from a first pressure to a second pressure while the metal within the mold is in its liquid phase, an increase from the second pressure to a third pressure while the metal within the mold cools through its liquid/solid phase and an increase from the third pressure to a fourth pressure while the metal within the mold cools through the working portion of its solid phase. Preferably, the increase from the first pressure to the second pressure is at least 50 PSI, the increase from the second pressure to the third pressure is at least 100 PSI, and the increase from the third pressure to the fourth pressure is at least 500 PSI. Alternatively, the predetermined rate is defined as an increase from a first pressure to a second pressure while the metal within the mold cools through the working portion of its solid phase. In this instance, it is preferably to increase from the first pressure to the second pressure is at least 500 PSI. Alternatively, the predetermined rate is defined as an increase from a first pressure to a second pressure while the metal within the mold cools through its liquid/solid phase. In this instance, it is preferable to increase from the first pressure to the second pressure is at least 100 PSI.

In still another embodiment, the predetermined rate can be defined as an increase from a first pressure to a second pressure as the metal within the mold cools through its liquid/solid phase and an increase in pressure from the second pressure to a third pressure as the metal within the mold cools through the working portion of its solid phase. In this instance, the increase from the first pressure to the second pressure should be at least 100 PSI, while the increase from the second pressure to the third pressure is at least 300 PSI.

Preferably, the cooling step includes the step of directionally solidifying the metal and the increasing pressure step includes the step of cooling the metal within the mold with gas introduced into the vessel to pressure it. Preferably, before the increasing pressure step, there is the step of evacuating the pressure vessel. Alternatively, the vessel can be evacuated before the filling step or just after the filling step. Preferably in one application to make a composite before the filling step, there is the step of placing a reinforcement within the mold and there is the step of infiltrating the reinforcement with the molten metal.

The present invention is also a method for casting and densification which is characterized by the steps of filling a mold to a predetermined level with molten metal and then placing the mold with metal into a first pressure vessel. Then, there is the step of increasing pressure in the first vessel over time such that voids formed within the metal are substantially closed. Preferably, the placing step includes the step of placing molten metal into the first pressure vessel. Alternatively, the placing step includes the step of placing metal in a liquid/solid phase into the first pressure vessel. Preferably, the filling step includes the step of filling the mold in a second pressure vessel to a predetermined level with molten metal. Reinforcement can be placed within the mold and infiltrated during casting. The first and second pressure vessels can be evacuated before or just after the filling steps, before solidification.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

The present invention is a method for casting and densification, preferably in one operation. The method is comprised of the steps of filling a mold in a pressure vessel to a predetermined level with molten metal and then the step of increasing the pressure in the vessel such that voids formed within the metal are substantially closed without removing the mold with the metal from the pressure vessel. Preferably, after the increasing pressure step, there is the step of cooling the molten metal to ambient temperatures.

In one embodiment, and as shown in FIGS. 2*a*–2*e*, the increasing pressure step includes the step of increasing pressure in the vessel at a predetermined rate through the liquid, liquid/solid and solid phases of the metal. Alternatively, the increasing pressure step includes the step of increasing pressure at a predetermined rate through the liquid/solid and solid phase of the metal. Alternatively, the increasing pressure step includes the step of increasing pressure at a predetermined rate through the solid phase of the metal. The method is not limited to a type of mold. For instance, investment or permanent molds can be used.

Figure 1:
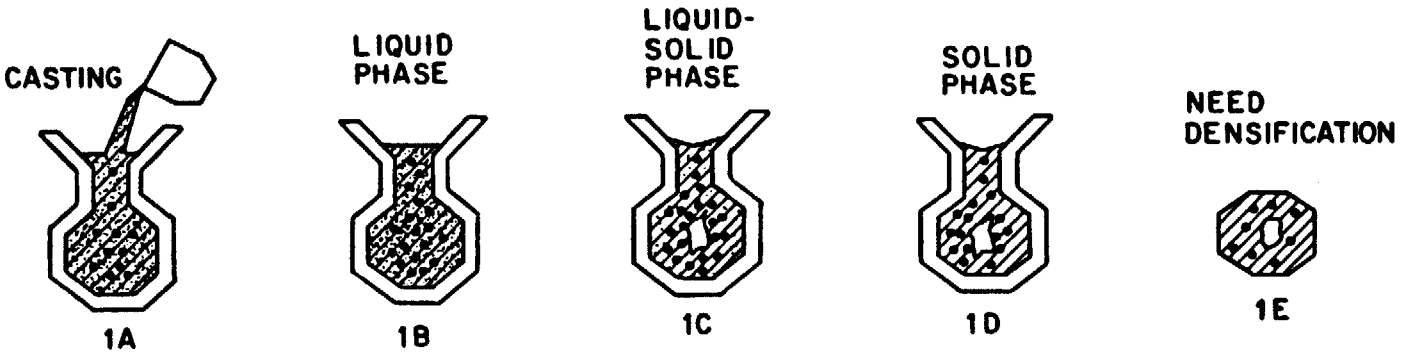
PRIOR ART FIG. 1
FIGS. 1*a*–1*e* are schematic representations showing a typical casting process.
Figure 2:
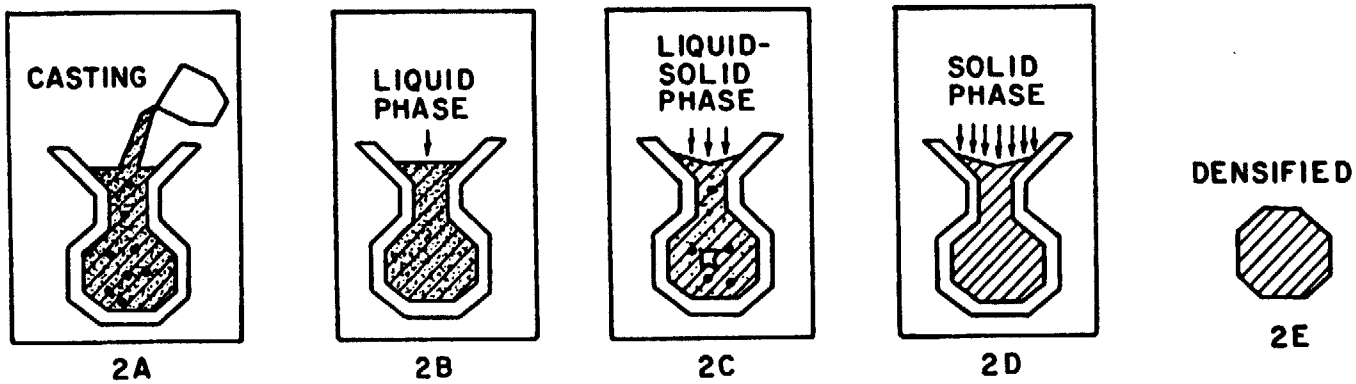
FIGS. 2*a*–2*e* are schematic representations showing a casting process of the present invention.

In a preferred embodiment, the predetermined rate is defined as an increase from a first pressure to a second pressure while the metal within the mold is in its liquid phase, as shown in FIG. 2*b*, an increase from the second pressure to a third pressure while the metal within the mold cools through its liquid/solid phase, as shown in FIG. 2*c*, and an increase from the third pressure to a fourth pressure while the metal within the mold cools through the working portion of its solid phase, as shown in FIG. 2*d*. Preferably, the increase from the first pressure to the second pressure is at least 25–500 PSI, and preferably 50 PSI, the increase from the second pressure to the third pressure is at least 50–1000 PSI, and preferably 100 PSI, and the increase from the third pressure to the fourth pressure is at least 200–2000 PSI, and preferably 500 PSI.

Alternatively, the predetermined rate is defined as an increase from a first pressure to a second pressure while the metal within the mold cools through the working portion of its solid phase. In this instance, the increase from the first pressure to the second pressure is at least 200–2000 PSI, and preferably 500 PSI. Alternatively, the predetermined rate is defined as an increase from a first pressure to a second pressure while the metal within the mold cools through its liquid/solid phase. In this instance, the increase from the first pressure to the second pressure is at least 50–1000 PSI, and preferably 100 PSI. In still another embodiment, the predetermined rate can be defined as an increase from a first pressure to a second pressure as the metal within the mold cools through its liquid/solid phase and an increase in pressure from the second pressure to a third pressure as the metal within the mold cools through the working portion of its solid phase. In this instance, the increase from the first pressure to the second pressure should be at least 50–1000 PSI, and preferably 100 PSI, while the increase from the second pressure to the third pressure is at least 75–1500 PSI, and preferably 300 PSI. Generally, the pressure is preferably greater at each stage of densification than the previous stage of densification. The time at each stage of densification can vary from 2 seconds to days, if desired, depending on the material and pressure involved in the densification. Furthermore, the increase in pressure at each stage can be linear or vary as a function of time, such as a step function where each step is at a greater pressure than the previous pressure, or such as a constant slope function, or an increasing slope function. Thus, the pressure at each stage of densification can vary or be fixed, or be a combination of some or all of the above, as desired.

Preferably, the cooling step includes the step of directionally solidifying the metal and the increasing pressure step includes the step of cooling the metal within the mold with gas introduced into the vessel to pressure it. Preferably, before the increasing pressure step, there is the step of evacuating the pressure vessel. Alternatively, the vessel can be evacuated before or just after the filling step.

Figure 4:
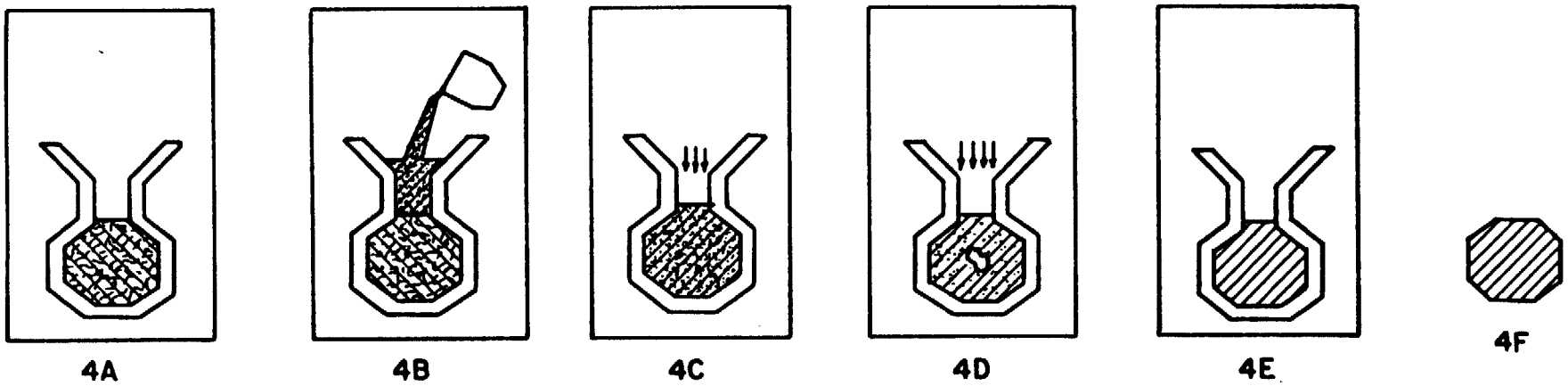
FIGS. 4*a*–4*f* are schematic representations showing a casting process of the present invention involving reinforcement.

As shown in FIG. 4, in one embodiment to produce densified composites preferably before the filling step, as shown in FIG. 4*b*, there is the step of placing a reinforcement within the mold, as shown in FIG. 4*a*, and there is the step of infiltrating the reinforcement with the molten metal, as shown in FIG. 4*c*. The subsequent steps can be the same as those described above.

The present invention is also a method for casting and densification which is characterized by the steps of filling a mold to a predetermined level with molten metal and then placing the mold with metal into a first pressure vessel. Then, there is the step of increasing pressure in the first vessel over time such that voids formed within the metal are substantially closed. Preferably, the placing step includes the step of placing the mold containing molten metal into the first pressure vessel. Alternatively, the placing step includes the step of placing metal in a liquid/solid phase into the first pressure vessel. Preferably, the filling step includes the step of filling the mold in a second pressure vessel to a predetermined level with molten metal. Reinforcement can be placed within the mold and infiltrated during casting. The first and second pressure vessels could be evacuated before or just after the filling steps.

In a detailed description of the operation of the invention, 6061 aluminum is cast and densified in one operation. It should be noted that 6061 aluminum is normally not used as a casting alloy because of its liquid-solid phase shrinkage which is difficult to control with current casting processes. However, with this invention, it is possible to cast fully dense 6061 aluminum components. First, 6061 aluminum is melted in a vacuum/pressure vessel to a temperature over its 650° C. liquid temperature (750° C. is the standard casting temperature used). The 6061 aluminum melt is then poured into a mold inside the pressure vessel. Normally high mold temperatures near or above the 650° C. liquid melt temperature are used. After the melt enters the mold, pressurized gas is introduced into the pressure vessel through two gas ports disposed below the mold such that it hits the bottom of the mold when it enters the vessel. This technique is described in detail in patent application serial number 07/594,348. The gas pressure acts to close trapped porosity in the liquid aluminum and to start directional solidification at the bottom of the mold.

Increasing the pressure on the liquid metal forces internal voids closed, the amount of closure is controlled by Boyle's Law, $Pv=NRT$. For example, if the metal was cast in the mold at 1 psi and voids inside are at 1 psi by increasing the pressure on the liquid metal to 2 psi, the voids would be about half the volumetric size. In the liquid phase, voids can be closed up easily by pressurizing the liquid metal which transfers the forces without requiring any work on the metal itself. Some of the gas pockets in the metal may also go into solution into the metal when pressure is applied. The greater the pressure the greater the reduction in void size. If the metal is poured in a vacuum or low pressure, then relatively low pressures, 1 to 10 atmospheres, can completely close most voids below a micron in size. With a helical grain starter, single crystal growth can be initiated with the gas hitting the bottom of the mold. The rate of pressure increase affects the cooling rate of the casting; the more gas, the faster the cooling rate. A pressurization rate is normally selected such that the pressure increases from vacuum to over 100 psi in the vessel before the casting goes into the liquid-solid phase. For small castings this can take a few seconds, while in large castings it can take a few minutes. The rate of pressurization is therefore varied with the size of the casting, the metal, and other conditions.

Figure 3:
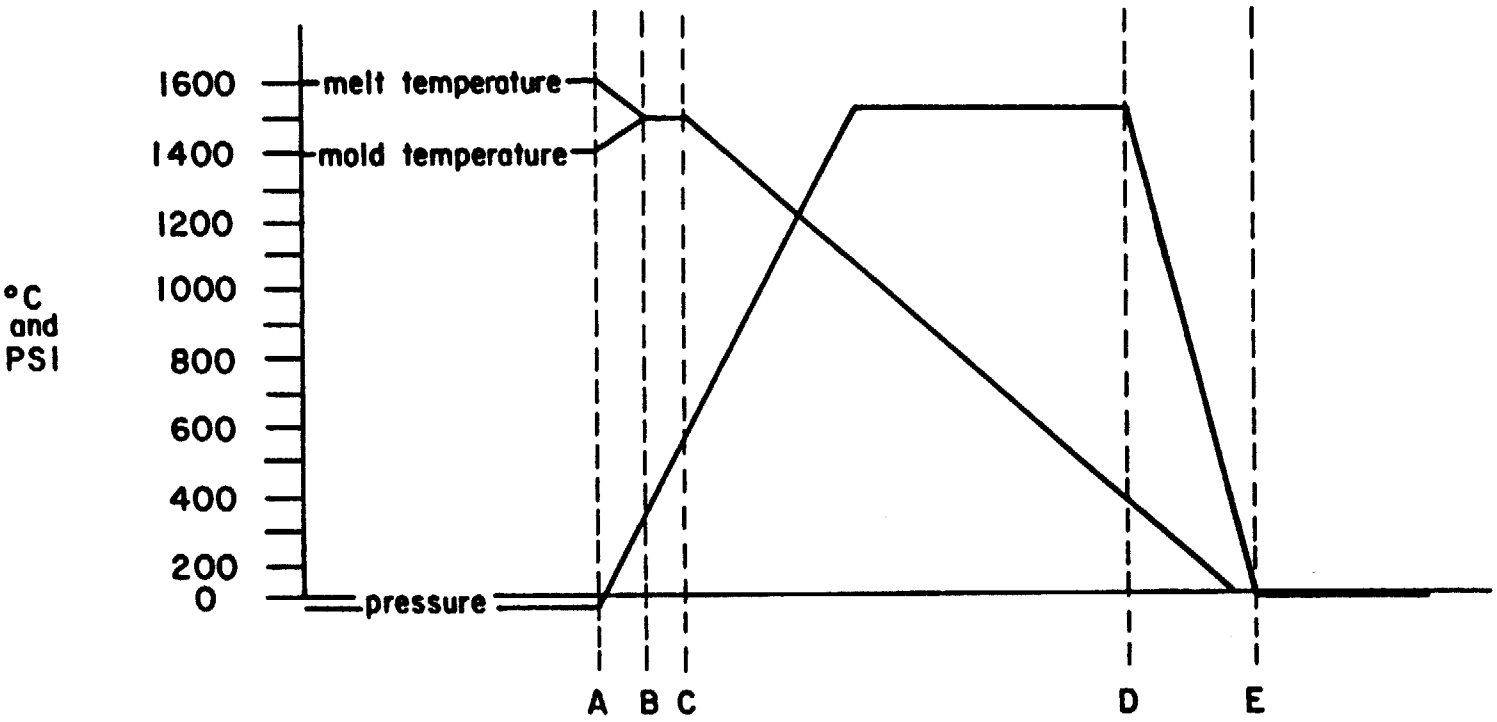
FIG. 3 is a graph showing a preferable pressure and temperature curve of the present invention.

A typical pressurization/temperature curve with respect to time is shown in FIG. 3. Point A represents the initial introduction of the molten metal into the mold. Point A is when pressurization is started. As shown between points A and B, since the melt is at a higher temperature than the mold, it cools slightly while the mold heats up slightly. The vessel is in an evacuated state to Point A after which it is subject to increasing pressure continually until, for instance, the metal has solidified past its working portion. At point B, the mold and the melt are at essentially the same temperature. Between points B and C, the casting is solidifying while pressure is increased. At point C, the casting begins to drop in temperature. Between points C and D, the casting continues to cool, while pressure is continually increased and then held constant at a specific peak level. Between points D and E, the vessel is depressurized while the casting completely cools to ambient temperature. At point E, the casting is removed from the vessel fully densified.

As shown in FIG. 3, the pressure continues to increase as the main body of the casting goes through the liquid-solid transition phase. In the liquid-solid phase of aluminum, shrinkage voids are normally around 4% of the casting volume. This depends on the nature of this phase and decreases with alloys that are closer to eutectic. The constant supply of additional increasing pressure helps to keep gas pocket formation to a minimum as the temperature and solubility drops, and acts to close shrinkage porosity or keep it from forming by adding new forces to force the solid surface of the casting in towards the liquid areas and possible shrinkage areas. Increasing the pressure in the vessel from around one hundred psi to three to five hundred psi during this liquid-solid transformation normally hinders the formation of all but very small gas and shrinkage voids evenly spread in thicker sections or at thickness transitions.

By increasing the pressure even higher while the 60 aluminum's temperature is dropping to its solid and below, the very soft 6061 can be worked easily and any of the small voids which may have formed during the liquid-solid transition phase can be forced closed. The pressure is normally increased from a few hundred to over one or two thousand psi. For most 6061 aluminum castings, increasing the pressure from three to five hundred psi while the casting drops from 650° C. to 550° C. is enough to close any remaining porosity. The actual rate depends on the size of the casting. On small castings, this can be accomplished in ten seconds, however, longer times are required as the casting size increases.

Because castings are often complex with different cross sections, different parts of the casting cool at different rates and go through phase changes at different times. For this reason, having distinct steps of pressurization is not recommended except on very large castings. Instead, a constant pressure rate increase is done such that it does not matter which phase any of the part is in, only that it is experiencing and increase in force to prevent porosity as it cools through the phases. In small castings, it is possible to use a constant pressure rate increase from vacuum to fifteen hundred psi in one minute to totally densify and cool the part below 550° C. Larger castings require significantly more time and much slower pressurization rates through all the phases. Castings with many different cross section thicknesses may require even higher final pressures to assure full densification in thinner areas which will cool more rapidly. By studying the phase diagram for the alloy to be cast and its geometry it is possible to select an appropriate controlling rate with a small amount of testing.

After the 6061 aluminum casting is below the working temperature of the metal ($\approx$550° C.) the pressure is held constant until the temperature of the casting drops to an acceptable removal temperature. The cool high pressure gas helps conduct the heat out of the part rapidly. Small castings can drop from 550° C. to room temperature in 10 minutes or less. Larger castings can normally be dropped to room temperature in 30 minutes. Gas can be cooled to achieve even higher cooling rates by conducting heat to water cooled surfaces in thermal contact with gas or with the mold, or by removing the gas, cooling it down, and then reentering it into the vessel. Vacuum also does not need to be used. For example, low pressure inert gas should be used to start the process with magnesium.

The use of the gas to infiltrate, densify and rapidly cool the casting greatly lowers the amount of reactions that occur, and therefore the amount of gas formed. This is much better than the current methods which have slower cooling and require reheating and pressurizing the casting over long periods (many hours) in a HIP to accomplish the same goals. The present invention requires less exposure time at high temperatures and results in better castings.

As a second example, copper is infiltrated into SiC reinforcement to form a composite component which is cast and densified in one step. The production and densification of a composite is basically the same as the casting and densification of a monolithic component. First as shown in FIG. 4*a*, the reinforcement or reinforcement preform is placed in a mold within a pressure vessel. The mold and melt are heated in a vacuum such that the mold is heated slightly above the 1082° C. liquid temperature of OFHC copper while the copper is heated to 1,200° C. Then, as shown in FIG. 4*b*, copper is then poured into the mold to seal off the vessel from the preform, isolating the vacuum inside the preform of reinforcement material. The pressure is then increased, as shown in FIG. 4*c* first forcing liquid copper into the preform and then further increased, as shown in FIG. 4*d* to close gas and shrinkage porosity and help to directionally solidify and cool the casting. Because copper is such a good conductor it cools very quickly through the different phases and therefore requires higher pressurization rates and final pressures than aluminum. Total casting times are often less than a few minutes. FIG. 4*e* shows the densified casting in the mold, while FIG. 4*f* shows the densified casting outside the mold.

Fully dense NiAl castings can also be provided with this invention. The casting and densification of NiAl is basically the same as the other systems except that much higher temperatures are required. Higher final pressures are normally required due to the greater likelihood of mold and other reactions. The mold and melt are heated in a vacuum such that the mold is around 1700° C. and the melt is over 1750° C. The metal is then poured into the mold and pressurized at a controlled rate through the liquid, liquid-solid, and solid phases. Pressure is increased until the temperature is below 1500° C. and then the pressure is held constant until the part is at the desired removal temperature. With a final pressure of 2000 psi total cool down to room temperature can be accomplished in 40 minutes.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for casting and densification comprising the steps of:

filling a mold in a pressure vessel to a predetermined level with molten metal; and increasing pressure in the vessel at a predetermined rate through at least a stage of the casting process which is subsequent to the entire molten metal solidified as solid phase such that voids within the metal are substantially closed without removing the mold with the metal from the pressure vessel.

2. A method as described in claim 1 wherein the increasing pressure step includes the step of increasing pressure in the vessel at a predetermined rate through the liquid, liquid/solid and solid phases of the metal.

3. A method as described in claim 1 wherein the increasing pressure step includes the step of increasing pressure in the vessel at a predetermined rate through the liquid/solid and solid phases of the metal.

4. A method as described in claim 2 wherein the mold is an investment mold.

5. A method as described in claim 2 wherein the mold is a permanent mold.

6. A method as described in claim 2 wherein the predetermined rate is defined as an increase from a first pressure to a second pressure while the metal within the mold is in its liquid phase, an increase from the second pressure to a third pressure while the metal within the mold cools through its liquid/solid phase and an increase from the third pressure to a fourth pressure while the metal within the mold cools through the working portion of its solid phase.

7. A method as described in claim 6 wherein the increase from the first pressure to the second pressure is at least 50 psi, the increase from the second pressure to the third pressure is at least 100 psi, and the increase from the third pressure to the fourth pressure is at least 500 psi.

8. A method as described in claim 1 wherein the predetermined rate is defined as an increase from a first pressure to a second pressure while the metal within the mold cools through the working portion of its solid phase.

9. A method as described in claim 8 wherein the increase from the first pressure to the second pressure is at least 500 psi.

10. A method as described in claim 3 wherein the predetermined rate is defined as an increase from a first pressure to a second pressure while the metal within the mold cools through its liquid/solid phase.

11. A method as described in claim 10 wherein the increase from the first pressure to the second pressure is at least 100 psi.

12. A method as described in claim 3 wherein the predetermined rate is defined in an increase from a first pressure to a second pressure as the metal within the mold cools through its liquid/solid phase and an increase in pressure from the second pressure to a third pressure as the metal within the mold cools through the working portion of its solid phase.

13. A method as described in claim 12 wherein the increase from the first pressure to the second pressure is at least 100 psi and the increase from the second pressure to the third pressure is at least 300 psi.

14. A method as described in claim 1 including the step of directionally solidifying the metal within the mold.

15. A method as described in claim 1 wherein the increasing pressure step includes the step of cooling the metal within the mold with gas introduced into the vessel to pressurize it.

16. A method as described in claim 1 wherein before the increasing pressure step, there is the step of evacuating the pressure vessel.

17. A method as described in claim 1 wherein before the filling step, there is the step of placing a reinforcement within the mold, and after the filling step, there is the step of infiltrating the reinforcement with the molten metal.

18. A method as described in claim 17 wherein the increasing pressure step includes the step of increasing pressure in the vessel a predetermined rate through the liquid, liquid/solid and solid phases of the metal.

19. A method as described in claim 1 wherein the increasing pressure step includes the step of increasing pressure in the vessel a predetermined rate through the liquid, liquid/solid and solid phases of the metal.

20. A method for casting the densification comprising the steps of:

filling a mold to a predetermined level with molten metal;

placing the mold with metal into a first pressure vessel; and increasing pressure in the first vessel over time at a predetermined rate through at least a stage of the casting process which is subsequent to the entire molten metal solidified as solid phase such that voids formed within the metal are substantially closed.

21. A method as described in claim 20 wherein the placing step includes the step of placing a mold containing molten metal into the first pressure vessel.

22. A method as described in claim 20 wherein the placing step includes the step of placing metal in a mold in a liquid/solid phase into the first pressure vessel.

23. A method as described in claim 20 wherein the filling step includes the step of filling the mold in a second pressure vessel to a predetermined level with molten metal.

24. A method as described in claim 23 including before the filling step, there is the step of introducing reinforcement into the mold; and after the filling step, there is the step of infiltrating the molten metal into the reinforcement in the second pressure vessel.

25. A method as described in claim 23 including before the filling step, there is the step of evacuating the second pressure vessel.

26. A method as described in claim 20 including before the filling step, there is the step of evacuating the second pressure vessel.

* * * * *